United States Patent [19]

Gregor et al.

[11] 4,366,004

[45] Dec. 28, 1982

[54] METHOD OF INTERNALLY CLEANING COKE CHAMBER RISERS

[75] Inventors: Karl Gregor, Bochum; Kurt Asmus, Erftstadt, both of Fed. Rep. of Germany

[73] Assignee: Gewerkschaft Schalker Eisenhütte, Gelsenkirchen, Fed. Rep. of Germany

[21] Appl. No.: 172,196

[22] Filed: Jul. 25, 1980

[30] Foreign Application Priority Data

Jul. 26, 1979 [DE] Fed. Rep. of Germany ..... 2930351

[51] Int. Cl.[3] ..... C23G 3/04

[52] U.S. Cl. ..... 134/22.11; 134/24; 134/39; 201/2; 202/241

[58] Field of Search ..... 201/2; 196/122; 422/187; 202/241; 134/8, 39, 22 C, 2, 20, 24, 22 R, 22.11, 22.1; 208/48 Q

[56] References Cited

U.S. PATENT DOCUMENTS

| | | | |
|---|---|---|---|
| 49,329 | 8/1865 | White | 201/2 |
| 1,796,878 | 3/1931 | Watson | 202/241 |
| 3,507,929 | 4/1970 | Happel et al. | 134/2 |
| 3,841,977 | 10/1974 | Stanke et al. | 201/2 |
| 3,933,595 | 1/1976 | Gordon et al. | 201/2 |
| 3,964,976 | 6/1976 | Pettrey, Jr. | 201/2 |
| 4,013,518 | 3/1977 | Miko | 202/241 |
| 4,039,393 | 8/1977 | Rankin | 202/241 |
| 4,107,001 | 8/1978 | Kinzler | 201/2 |

*Primary Examiner*—Kenneth M. Schor
*Assistant Examiner*—Michael L. Goldman
*Attorney, Agent, or Firm*—Karl F. Ross

[57] ABSTRACT

A method of and an apparatus for cleaning the interiors of risers of coking chambers of a coke oven wherein a head provided with scrapers, hydraulic cleaning means or oxygen supply for burning off deposits, is introduced laterally into the coking furnace below the riser and caused to elevate through the riser. Thereafter the head is lowered and the apparatus withdrawn laterally through the coking chamber.

1 Claim, 3 Drawing Figures

METHOD OF INTERNALLY CLEANING COKE CHAMBER RISERS

FIELD OF THE INVENTION

Our present invention relates to a method of internally cleaning risers of coking chambers of coking ovens and, more particularly, to a system for the internal cleaning of the gas-conducting risers of coking chambers.

BACKGROUND OF THE INVENTION

A coking oven generally comprises a number of coking chambers arranged in row, each of which can be provided on its roof with a riser for carrying away the gases generated during the coking process.

The riser is usually a ceramic-lined steel or iron pipe which can have a length or height of, say, 4–6 meters, comparable in height to the height of the coking chamber.

At its upper end, the riser is provided with a reasonable cover and adjacent its upper end with a lateral fitting for connecting the riser to a subsequent apparatus such as a recuperator for recovering part of the heat generated in the coking process or a gas-cleaning installation. The gas which is generated in the coking chamber, can pass or be drawn by suction through the riser.

Between the fitting and the apparatus a valve or the like is generally provided. The valve can include or be a water trap.

From time to time risers of the aforedescribed type, which accumulate soot, carbon black and heavier deposits of combustible material, must be cleaned to eliminate the cross section reduction caused by such deposits.

In one conventional process for the internal cleaning of such risers, the cover is removed and a weighted cleaning head is dropped through the top of the riser and lowered therethrough. The cleaning head can be raised and lowered repeatedly to effect the desired degree of cleaning.

The cleaning action of the cleaning head can be accomplished by mechanical means, e.g. brushes or blades which physically dislodge the deposits. It is also known to introduce an oxygen lance through the top of the riser and to lower it while directing oxygen against the deposits at a temperature sufficient to cause combustion thereof. In a third cleaning technique, jets of water are directed at extremely high pressure against the deposits to dislodge them. The latter technique is hereinafter referred to as hydraulic and the head as a hydraulic cleaning head.

With all of these conventional processes the cleaning of the riser is problematical since the open upper end of the riser serves as a means for escape of the detritus which is dislodged from the wall of the pipe or gases which are generated by the combustion of such deposits.

In addition, emission from the chamber itself may occur.

The uncontrolled emission of particles and gases during the cleaning process is a severe disadvantage.

OBJECTS OF THE INVENTION

It is thus the principal object of the present invention to provide a method of cleaning a riser of the aforedescribed type to eliminate the drawbacks of earlier systems and especially the uncontrolled emission of particulates and combustion gases from the riser.

SUMMARY OF THE INVENTION

This object and others which will become apparent hereinafter are attained, in accordance with the present invention, by a method in which the cleaning head is initially laterally introduced into the coking chamber through an open door thereof and then raised into the riser to be cleaned and upwardly along the riser while maintaining the cover of the latter in place.

After the cleaning action has been concluded, the cleaning head is lowered from the riser and withdrawn laterally from the coking chamber through the open door thereof.

Thus at no time is the cover of the riser removed so that direct emission from the riser upwardly into the environment is excluded.

Another advantage of the method of the invention is that the cover or roof of the coking chamber does not have to carry the weight of the cleaning device and the cleaning device can be fully controlled from below. As a result there is less damage to the refractory lining of the riser than with earlier systems.

Obviously the cleaning process can use the same cleaning techniques as the prior art, namely a mechanical cleaning head or a hydraulic cleaning head. The cleaning head can additionally be provided with means which introduces oxygen on the surface of the riser to burn off removed deposits or deposits still in place upon the ceramic liner.

Advantageously, the mechanical cleaning operation, using brushes or rotary blades, is combined with a combustion cleaning in the manner described.

To exclude emissions to the exterior and even emissions which might emerge from the door region of the coking chamber it has been found to be advantageous to maintain the riser connected with the subsequent apparatus so that any gases generated within the coking chamber or within the riser can be drawn off by suction to this apparatus.

Even emissions which might tend to emerge from the door region can be excluded when, in accordance with the principle of the invention, the subsequent apparatus is connected as described, and continues to draw gases through the riser and a substoichiometric quantity of oxygen is used to burn off the deposits. In other words, we have found that when the oxygen supply is slightly less than that required to fully burn off all of the deposits, the tendency for emission to the exterior is reduced provided the suction is maintained through the riser.

Any residual deposits in the riser have been found to be no difficulty.

A cleaning apparatus for risers in accordance with the present invention can comprise a main carrier which can be connected to a coking carriage adapted to carry coke away from the furnace or to the pusher intended to displace the body of coke from the chamber into the carriage, the main carrier being connected to an auxiliary carrier. The auxiliary carrier is provided with a head and, because of the relatively comparable heights of the riser and the coking chamber, the auxiliary carrier can be connected to the main carrier so as to be elevatable and lowerable within the coking chamber and thereby raise and lower the cleaning head. Alternatively, the auxiliary carrier, which is formed as an outrigger from the main carrier and can pass through the door of the coking furnace, can be provided with a telescopingly elevatable arrangement carrying the cleaning head.

In the first case, the cleaning head and its stand must be of such length that it can extend the full length of the riser. In the second case, the fully extended telescoping stand should have a length corresponding to the height of the coking chamber plus the height of the riser. In the first case, moreover, the riser length cannot exceed the height of the chamber.

The means for raising and lowering the head can be any conventional linear displacement system, for example, a chain and sprocket drive, although the telescoping device can utilize a hydraulic system for raising and lowering the riser.

The main carrier or support should be provided with means enabling the horizontal displacement of the head through the open door of the coking chamber and the conventional lateral displacement means of the coking carriage or the pusher can be used to this end.

This latter means should, of course, be located to the greatest extent possible outside the coking chamber so as not to be subject to the high temperatures thereof.

The preferred coking head of the present invention comprises shaving or scraping blades which are mounted on a rotatable wheel at the upper end of the head and upon a tube forming part of the stand which can deliver oxygen or air to nozzles in the head disposed below these rotary blades. These nozzles can be connected to an air or oxygen source external of the coking chamber to supply the combustion-sustaining gas for burning off the deposits.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
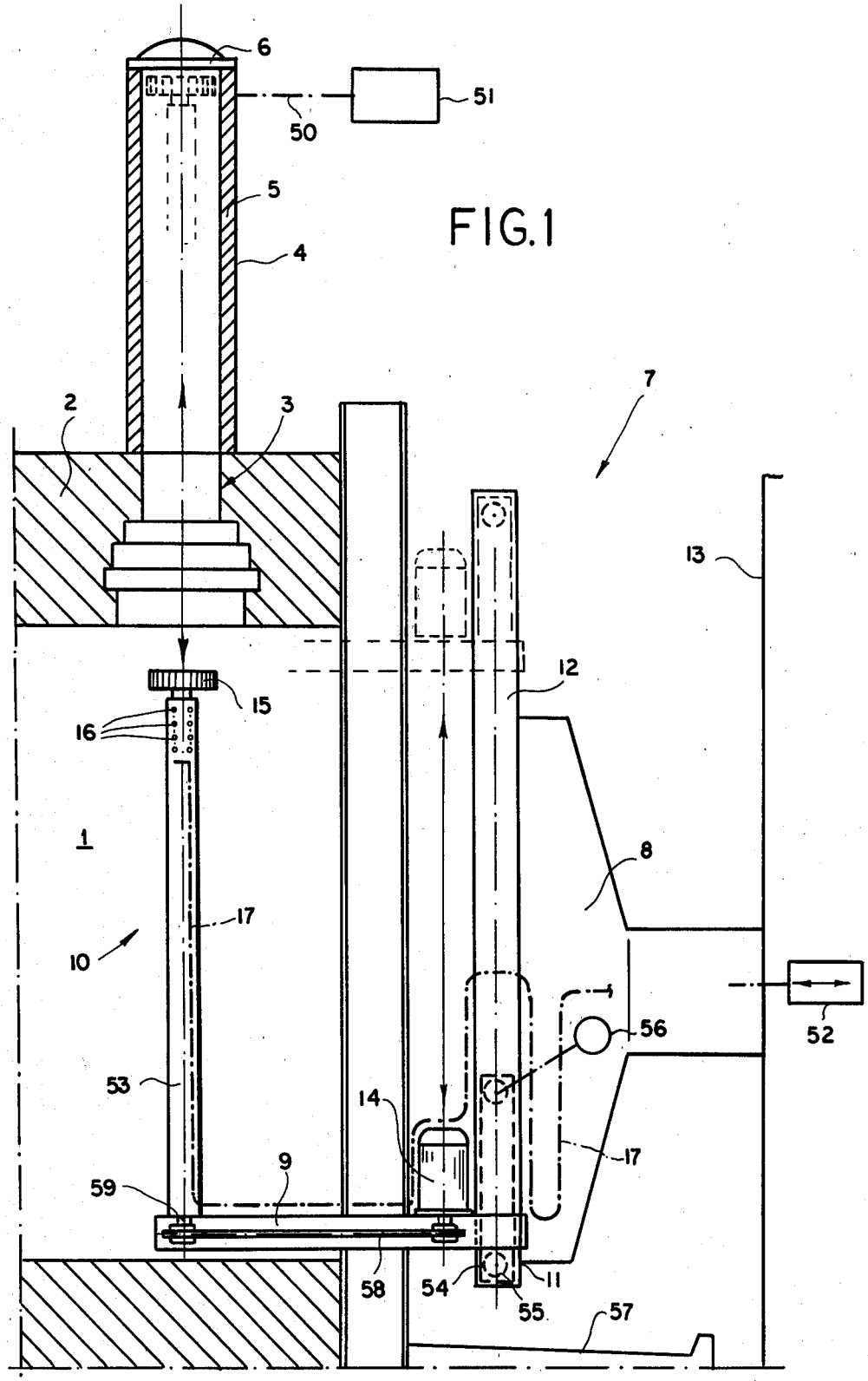
FIG. 1 is a diagrammatic vertical section of a portion of a coking furnace utilizing the cleaning apparatus of the present invention.

In the drawings we have shown a coking chamber 1 in highly schematic form, in the roof of which is provided an opening 3 for discharging the coking gases. The roof 2 also carries an upwardly extending riser 4 which has a ceramic lining 5 of refractory material and at its upper end is provided with a gas-tight cover 6.

As represented schematically at 50, the upper end of the riser is also connected to the gas processing installation represented at 51 and, during the operation of the process of the present invention a continuous connection is maintained so that gases are drawn off by the gas processor 51.

To clean the interior of the riser 4, we provide a cleaning unit 7 which comprises a main carrier 8 which can be shifted by any conventional drive laterally through the open door of the coking chamber, this drive being represented diagrammatically at 52. The main carrier 8 supports an outrigger-type cantilevered horizontally extending auxiliary carrier 9 upon the free end of which is mounted a cleaning head 10.

The latter comprises a stand 53 in the form of a post and will be described in greater detail hereinafter.

A mechanism for raising and lowering the cleaning head is represented diagrammatically at 11.

This mechanism can comprise a vertically extending rail 12 in which a carriage 54 is guided and this carriage can be formed with gears 55 engaging the rack of the rail (not shown) and driven by a chain drive from a motor represented diagrammatically at 56. Thus the means for raising and lowering the head is wholly external of the chamber.

The outrigger 9 can be raised to the broken line position shown at the top of the rail 12 during the operation.

The main carrier 8 can be mounted upon the carriage 13 which is provided with the trough 57 for receiving the coke bed.

The drive motor for the blade wheel 15 adapted to shave deposits from the refractory lining 5, is connected by a chain drive as represented at 58 with a vertical shaft at 59 extending upwardly through the post 53.

At the upper end of the hollow post 53, nozzles 16 are provided which can be connected as represented by the dot-dash line 17 to a source of oxygen or air for burning off the deposits.

In operation, the outrigger 9 is raised while the wheel 15 is driven and oxygen is delivered by the jets 60, thereby scraping the deposits from the lining 5 and burning these deposits. The combustion gases pass into the gas processing unit 51. In the embodiment shown in FIG. 2, the cleaning device 7 has an outrigger 109 which is fixed to the main carrier 108 on the pusher 113 which drives the coke out of the furnace.

In this case, the means 111 for raising and lowering the head 15 is a telescoping tube arrangement which is hydraulically operated.

The shaver 15 can be driven by a motor 14 in the manner previously described.

Figures 2, 3:
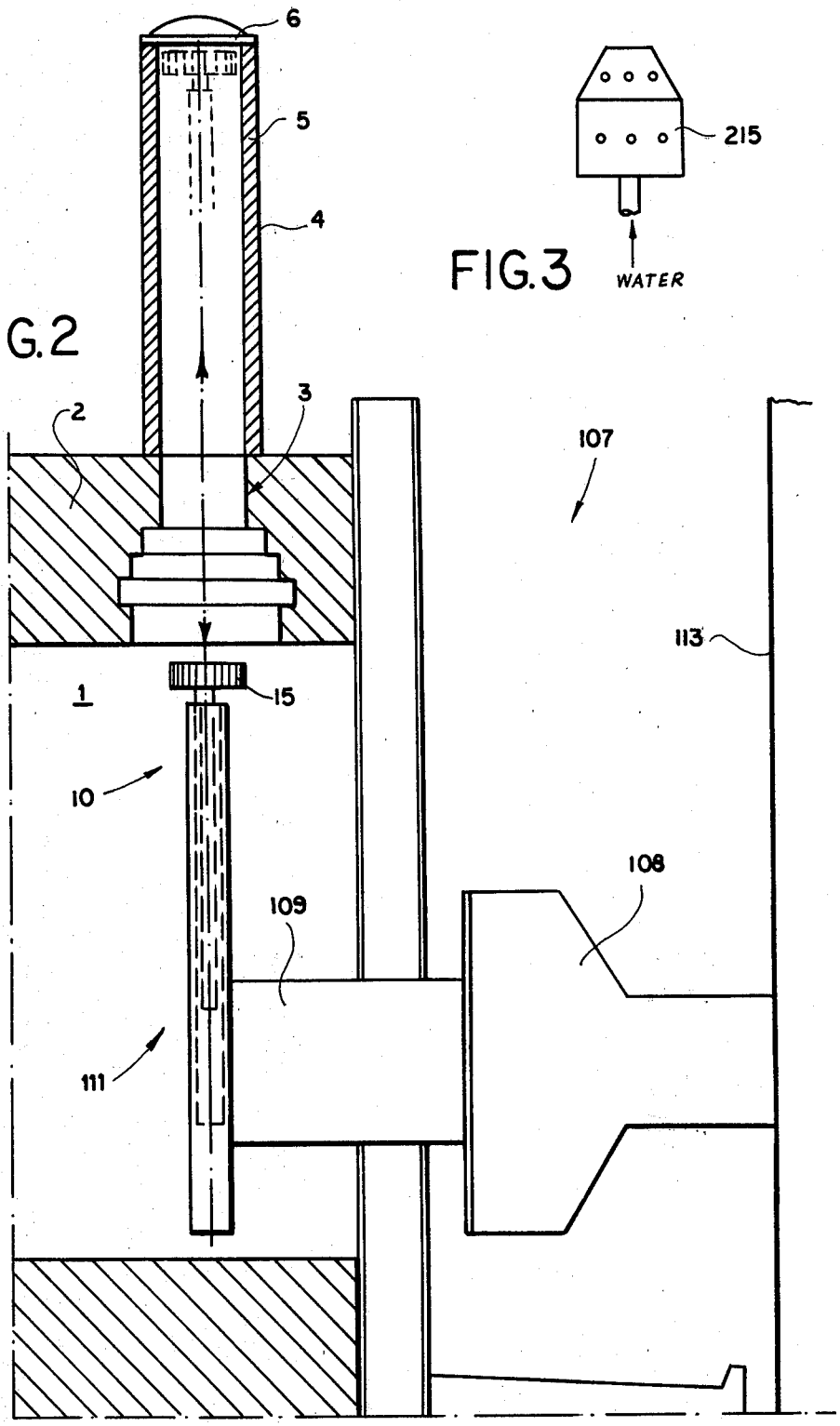
FIG. 2 is a similar view of another embodiment of the invention.
FIG. 3 is an elevational view of a hydraulic cleaning head which may be substituted for the cleaning head of FIGS. 1 and 2.

FIG. 3 shows another head 215 which is provided with nozzles from which water jets emerge at high pressure to dislodge the detritus.

We claim:

1. In a method of internally cleaning a riser of a coke oven chamber wherein a cleaning head is laterally introduced into said chamber through an open door thereof, and with said door open said head is elevated into said riser to remove deposits on the inner wall of said riser, upon removal of the deposits from the inner wall of said riser, said head is lowered from said riser, and thereafter the head is withdrawn laterally from the chamber, the improvement which comprises in combination:

(a) connecting said riser continuously during the entire cleaning process with a suction source capable of drawing gases from said riser;

(b) introducing a combustion-sustaining gas into said riser from said head and along said inner wall, said combustion-sustaining gas being selected from the group which consists of air and oxygen, whereby said deposits are burned off said inner wall and the burning of said deposits produces gases which are drawn from said riser in step (a); and (c) controlling the flow of said combustion-sustaining gas from said head to said riser to maintain the oxygen supplied to the burning of the deposits at a level less than a stoichiometric proportion.

* * * * *